US008095044B2

(12) United States Patent
Maeda et al.

(10) Patent No.: US 8,095,044 B2
(45) Date of Patent: Jan. 10, 2012

(54) ROTARY MEMBER DRIVING APPARATUS

(75) Inventors: Yoritsugu Maeda, Toride (JP); Jiro Shirakata, Chigasaki (JP); Jun Nakagaki, Abiko (JP); Satoshi Atarashi, Toride (JP); Yukihiro Fujiwara, Toride (JP); Dai Kanai, Abiko (JP); Jun Nakazato, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 483 days.

(21) Appl. No.: 12/413,403

(22) Filed: Mar. 27, 2009

(65) Prior Publication Data

US 2009/0245871 A1 Oct. 1, 2009

(30) Foreign Application Priority Data

Mar. 28, 2008 (JP) ..... 2008-086959

(51) Int. Cl.
*G03G 15/00* (2006.01)

(52) U.S. Cl. ..... 399/167

(58) Field of Classification Search ..... 399/110, 399/116, 117, 130, 159, 167, 302, 308
See application file for complete search history.

(56) References Cited

U.S. PATENT DOCUMENTS 7,657,208 B2 * 2/2010 Yahagi ..... 399/167

FOREIGN PATENT DOCUMENTS

JP 11-073065 3/1999
JP 2000-330420 11/2000

* cited by examiner

*Primary Examiner* — Hoan Tran
(74) *Attorney, Agent, or Firm* — Canon USA Inc IP Division

(57) ABSTRACT

A rotary member apparatus includes a main drive unit configured to apply a driving torque to a photosensitive drum through a drive transfer unit, a torque limiter configured to limit the driving torque transmitted from the main drive unit to the photosensitive drum, a compensation drive unit configured to apply a torque for adjusting an angular velocity of the photosensitive drum, an encoder configured to detect the angular velocity of the photosensitive drum, and a compensation drive controller configured to control the torque applied by the compensation drive unit on the basis of a detection result obtained by the encoder.

13 Claims, 9 Drawing Sheets

ROTARY MEMBER DRIVING APPARATUS

BACKGROUND OF THE INVENTION

1. Field of the Invention

The present invention relates to a rotary member driving apparatus which controls a rotary member such that the rotary member rotates at a target angular velocity.

2. Description of the Related Art

In copy machines and printers which form an image using a photosensitive drum, there is a problem that an angular velocity of the photosensitive drum varies due to an eccentricity or the like of a mechanism which transmits a driving force to the photosensitive drum. The variation in the angular velocity of the photosensitive drum causes variation in the pitch of a laser beam and color misregistration, and therefore it is difficult to improve the image quality. Thus, to improve the image quality, it is necessary to reduce the variation in the angular velocity.

According to a known technique, the angular velocity of the photosensitive drum is detected with an encoder or the like and feed-back control of a DC motor which drives the photosensitive drum is performed so as to reduce the variation in the rotational driving process by adjusting the driving force in accordance with the detected angular velocity.

According to this method, although variation in the angular velocity at a relatively low frequency can be reduced, variation in the angular velocity at a relatively high frequency cannot be reduced.

Therefore, in addition to the main driving member (DC motor) which drives the photosensitive drum, an auxiliary driving member, such as another motor or a brake, may be additionally used to reduce the variation in the angular velocity. In such a case, variation in the angular velocity with a relatively high frequency (100 Hz to 200 Hz) can also be reduced (see, for example, Japanese Patent Laid-Open No. 2000-330420). On the other hand, in an image forming apparatus including an acoustic wave motor with high rotational accuracy for driving a photosensitive drum, there may be a case in which the photosensitive drum cannot be driven when the torque is generated only by the acoustic wave motor. In such a case, an additional motor may be used to assist the rotation of the photosensitive drum (see, for example, Japanese Patent Laid-Open No. 11-073065).

However, since the auxiliary driving member additionally applies a driving force to the photosensitive drum while the main driving member is controlled so as to rotate the photosensitive drum at a predetermined angular velocity, feed-back control of the main driving member will be affected. Therefore, a complex control system is necessary and there is a possibility that the stability of the control system will be reduced. In addition, in the structure in which a plurality of photosensitive drums are driven by a single drive source, the main driving member and the auxiliary driving member influence each other. Therefore, the complexity of the control system increases and there is a possibility that the stability of the control system will be further reduced. In addition, although it is described in Japanese Patent Laid-Open No. 11-073065 that the additional motor for driving the photosensitive drum is provided with a torque limiter, the velocity control of the acoustic wave motor and the additional motor is not specifically described.

SUMMARY OF THE INVENTION

In light of the above-described problems, a rotary member driving apparatus according to an aspect of the present invention includes a driving unit configured to apply a driving torque to a rotary member through a transmission member; a torque limiting unit provided on the transmission member, the torque limiting unit limiting the driving torque transmitted from the driving unit to the rotary member; a compensation unit configured to apply a torque for adjusting an angular velocity of the rotary member; a first detection unit configured to detect the angular velocity or a peripheral velocity of the rotary member; a first control unit configured to control the torque applied by the compensation unit based on a detection result obtained by the first detection unit; a second detection unit configured to detect an angular velocity input to the torque limiting unit from the driving unit; and a second control unit configured to control an angular velocity of the driving unit based on a detection result obtained by the second detection unit.

Further features of the present invention will become apparent from the following description of exemplary embodiments with reference to the attached drawings.

DESCRIPTION OF THE EMBODIMENTS

Image-forming apparatuses according to embodiments of the present invention will be described below with reference to the drawings.

Figure 1:
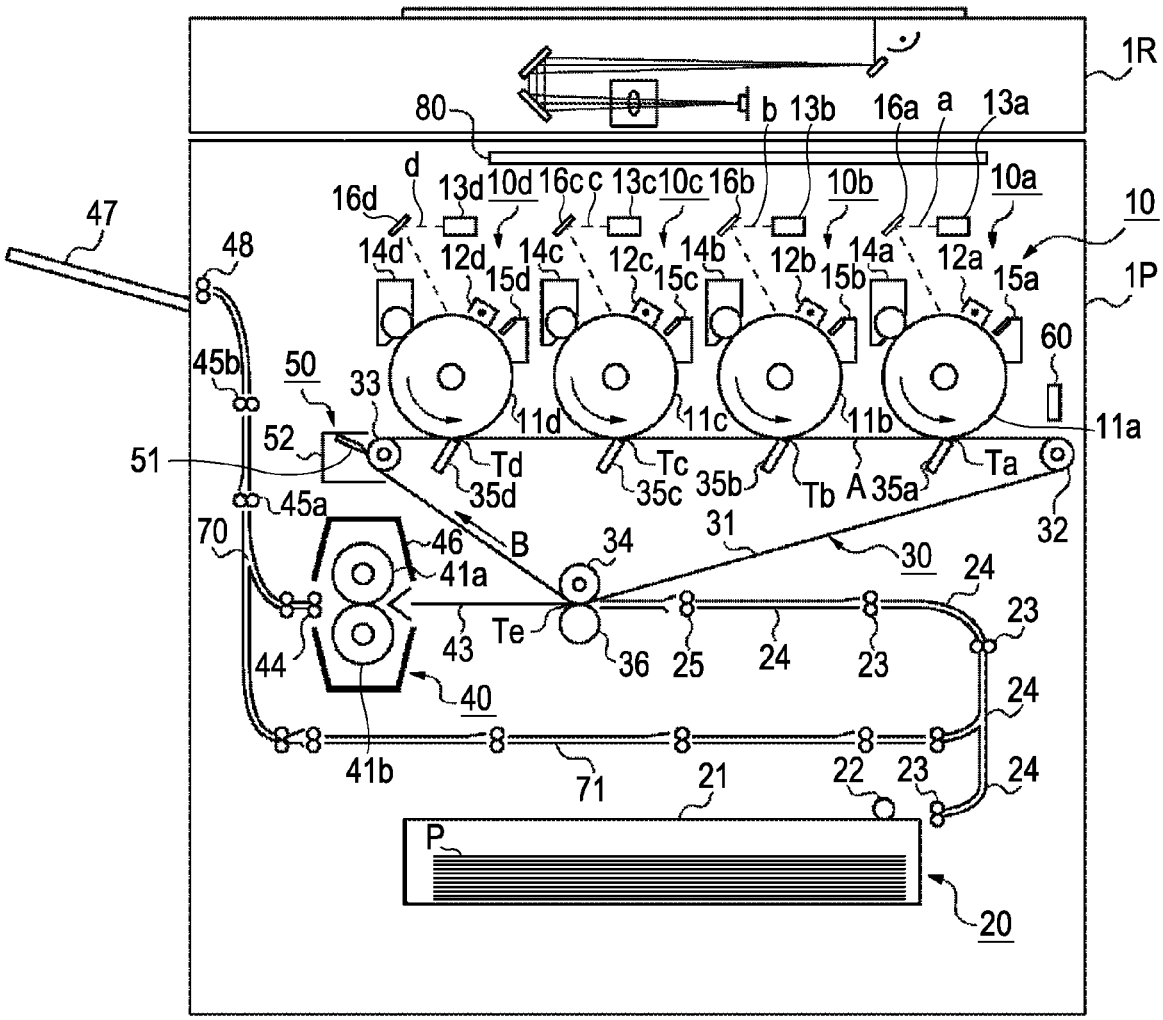
FIG. 1 is a sectional view of a color copy machine according to an embodiment of the present invention.

A first embodiment of the present invention will be described below referring to the drawings. FIG. 1 is a sectional view of a color copy machine according to an embodiment of the present invention. The color copy machine according to the embodiment includes a plurality of image forming units arranged next to each other and uses an intermediate transferring method. The color copy machine includes an image reading section 1R and an image output section 1P.

The image reading section 1R optically reads an image on a document, converts the image into an electric signal, and outputs the thus-obtained electric signal to the image output section 1P. The image output section 1P includes image forming units 10 (10*a*, 10*b*, 10*c*, and 10*d*) arranged next to each other, a paper feed unit 20, an intermediate transfer unit 30, a fixing unit 40, a cleaning unit 50, a photosensor 60, and a control unit 80.

Each of the above-mentioned units will be described in detail. All of the image forming units 10 (10*a*, 10*b*, 10*c*, and 10*d*) have the same structure. In each image forming unit 10, a photosensitive drum 11 (11*a*, 11*b*, 11*c*, and 11*d*), which serves as a first image bearing member, is supported such that the photosensitive drum 11 is rotatable in the direction shown by the arrow. A primary charger 12 (12*a*, 12*b*, 12*c*, and 12*d*), an exposure device 13 (13*a*, 13*b*, 13*c*, and 13*d*), a folding mirror 16 (16*a*, 16*b*, 16*c*, and 16*d*), a developing device 14 (14*a*, 14*b*, 14*c*, and 14*d*), and a cleaning device 15 (15*a*, 15*b*, 15*c*, and 15*d*) are arranged in a rotating direction of the photosensitive drum 11 (11*a* to 11*d*) so as to face the outer peripheral surface thereof.

The primary chargers 12*a* to 12*d* charge the surfaces of the photosensitive drums 11*a* to 11*d* with a uniform amount of electricity. Then, the exposure devices 13*a* to 13*d* emit laser beams toward the photosensitive drums 11*a* to 11*d* through the folding mirrors 16*a* to 16*d* in accordance with recording image signals obtained from the image reading section 1R. Thus, electrostatic latent images are formed on the photosensitive drums 11*a* to 11*d*.

Next, the developing devices 14*a* to 14*d*, which respectively store four colors (yellow, cyan, magenta, and black) of developer (hereinafter called toner), develop the electrostatic latent images on the photosensitive drums 11*a* to 11*d*. The thus-developed visible images (toner images) are transferred onto an intermediate transfer belt 31, which serves as a second image bearing member, in the intermediate transfer unit 30 at image transfer positions Ta, Tb, Tc, and Td.

The cleaning devices 15*a*, 15*b*, 15*c*, and 15*d*, which are positioned downstream of the image transfer positions Ta, Tb, Tc, and Td, respectively, clean the surfaces of the photosensitive drums 11*a* to 11*d* by removing the toner that remains on the drum surfaces instead of being transferred onto the intermediate transfer belt 31. An image is formed with the toner of the above-mentioned colors by the above-described processes.

The paper feed unit 20 includes a cassette 21 on which paper sheets P are stacked, a pick up roller 22 which feeds the sheets P one by one from the cassette 21, and a pair of paper feed rollers 23 which convey the sheet P fed by the pick up roller 22. The paper feed unit 20 also includes paper feed guides 24 and registration rollers 25 for feeding the sheet P to a secondary transfer position Te in synchronization with the image on the intermediate transfer belt 31.

The intermediate transfer unit 30 will now be described in detail. The intermediate transfer belt 31 is supported by a driving roller 32 which transmits a driving force to the intermediate transfer belt 31, a driven roller 33 which is rotated by the rotation of the intermediate transfer belt 31, and a secondary transfer roller 34. A primary transfer plane A is formed between the driving roller 32 and the driven roller 33. The driving roller 32 is rotated by a driving unit (not shown), such as a pulse motor.

Primary transfer chargers 35 (35*a* to 35*d*) are arranged on the back side of the intermediate transfer belt 31 at the primary transfer positions Ta to Td at which the intermediate transfer belt 31 faces the photosensitive drums 11*a* to 11*d*, respectively. A secondary transfer roller 36 is positioned so as to face the secondary transfer roller 34, and the secondary transfer position Te is defined as a nip point between the secondary transfer roller 36 and the intermediate transfer belt 31. The secondary transfer roller 36 is pressed against the intermediate transfer belt 31 at a suitable pressure.

The cleaning unit 50 used for cleaning an image forming surface of the intermediate transfer belt 31 is positioned downstream of the secondary transfer position Te of the intermediate transfer belt 31. The cleaning unit 50 includes a cleaning blade 51 used for removing the toner from the intermediate transfer belt 31 and a waste toner box 52 which stores the toner removed by the cleaning blade 51.

The fixing unit 40 includes a fixing roller 41*a* having a heat source, such as a halogen heater, disposed therein and another fixing roller 41*b* which is pressed against the fixing roller 41*a*. The fixing unit 40 also includes a guide 43 for guiding the sheet P to a nip section between the fixing rollers 41*a* and 41*b* and heat-insulating covers 46 for insulating the heat in the fixing unit 40. The fixing unit 40 also includes paper ejection rollers 44, vertical path rollers 45*a* and 45*b*, and paper ejection rollers 48 for guiding the sheet P conveyed from the fixing rollers 41*a* and 41*b* toward the outside of the apparatus and a paper output tray 47 onto which the sheet P is ejected.

The operation of the color copy machine having the above-described structure will now be described. When an image-forming-process start signal is output from a CPU, a paper feed operation for feeding sheets P from the cassette 21 is started. In the case where the sheets P on the cassette 21 are to be fed, first, the pick up roller 22 feeds the sheets P one by one from the cassette 21. Then, each sheet P is guided through the paper feed guides 24 by the paper feed rollers 23 and is conveyed to the registration rollers 25. At this time, the registration rollers 25 are stopped so that the leading end of the sheet P is stopped by a nip section between the registration rollers 25. Then, the registration rollers 25 start rotating in synchronization with the image formed on the intermediate transfer belt 31. The time at which the rotation of the registration rollers 25 is started is set such that the position of the sheet P corresponds to the position of the toner image on the intermediate transfer belt 31 at the secondary transfer position Te.

When the image forming process start signal is output, in the image forming section, the toner image formed on the photosensitive drum 11*d* is transferred onto the intermediate transfer belt 31 by the primary transfer charger 35*d* at the primary transfer position Td. Then, the toner image transferred onto the intermediate transfer belt 31 is conveyed to the primary transfer position Tc. At the primary transfer position Tc, an image forming process is started after a delay time corresponding to the time necessary for the toner image to move between the image forming units. Accordingly, another toner image is transferred onto the previous image at the corresponding position. Similar processes are successively performed by the other image forming units, so that toner images of four colors are primarily transferred onto the intermediate transfer belt 31.

Then, when the sheet P reaches the secondary transfer position Te and comes into contact with the intermediate transfer belt 31, a high voltage is applied to the secondary transfer roller 36 at the time when the sheet P passes the secondary transfer roller 36. Accordingly, the toner images of four colors formed on the intermediate transfer belt 31 by the above-described processes are transferred onto the sheet P. Then, the sheet P is guided to the nip section between the fixing rollers 41*a* and 41*b* by the guide 43. Then, the toner images are fixed on the sheet P by the heat and pressure applied by the fixing rollers 41*a* and 41*b*. Then, the sheet P is conveyed by paper ejection rollers 44, the vertical path rollers 45*a* and 45*b*, and the paper ejection rollers 48 and is thereby ejected to the outside of the apparatus and placed on the paper output tray 47.

Next, the operation performed to form images on both sides of the sheet P will be described. An example in which the sheet P is fed from the cassette 21 will be described. In this case, the sheet P fed from the cassette 21 is subjected to the above-described processes so that an image is formed on one side thereof. Then, the fixing process is performed by the fixing rollers 41*a* and 41*b*. After the image on one side of the sheet P is fixed, the sheet P is conveyed by the paper ejection rollers 44 and the vertical path rollers 45*a*. Then, when the trailing end of the sheet P is moved by a predetermined distance after passing through a position 70, the sheet P is conveyed in the opposite direction. A flapper (not shown) is provided at the position 70 so that the sheet P can be prevented from being conveyed to the fixing unit 40. The sheet P having the image formed on one side thereof passes through duplex printing guides 71 and is fed to the paper feed guides 24 again. Then, an image is formed on the other side of the sheet P by processes similar to those performed for forming the image on the first side, and the fixing process is performed by the fixing rollers 41*a* and 41*b*. Then, the sheet P is conveyed by paper ejection rollers 44, the vertical path rollers 45*a* and 45*b*, and the paper ejection rollers 48 and is thereby ejected to the outside of the apparatus and placed on the paper output tray 47.

Next, the operation of driving the photosensitive drums 11 will be described in detail with reference to FIG. 2. In the present embodiment, a main drive unit 100, such as a DC brushless motor and a stepping motor, is provided for each of the photosensitive drums 11*a* to 11*d*. The main drive unit 100 is controlled by a main drive controller 106. In addition, a compensation drive unit 103 is also provided for each of the photosensitive drums 11*a* to 11*d*. A traveling wave motor (hereinafter referred to as an ultrasonic motor (USM)) is used as the compensation drive unit 103.

The USM generates ultrasonic vibration of a stator (elastic body) and drives a rotor (moving body) with a frictional force. The USM moves the rotor by repeating small vibrations, and is therefore capable of driving the rotor with a large force at a low velocity. In addition, in the case were the USM is used, it is not necessary to reduce the rotational speed with gears. Therefore, the USM can be controlled with high accuracy.

Figure 2:
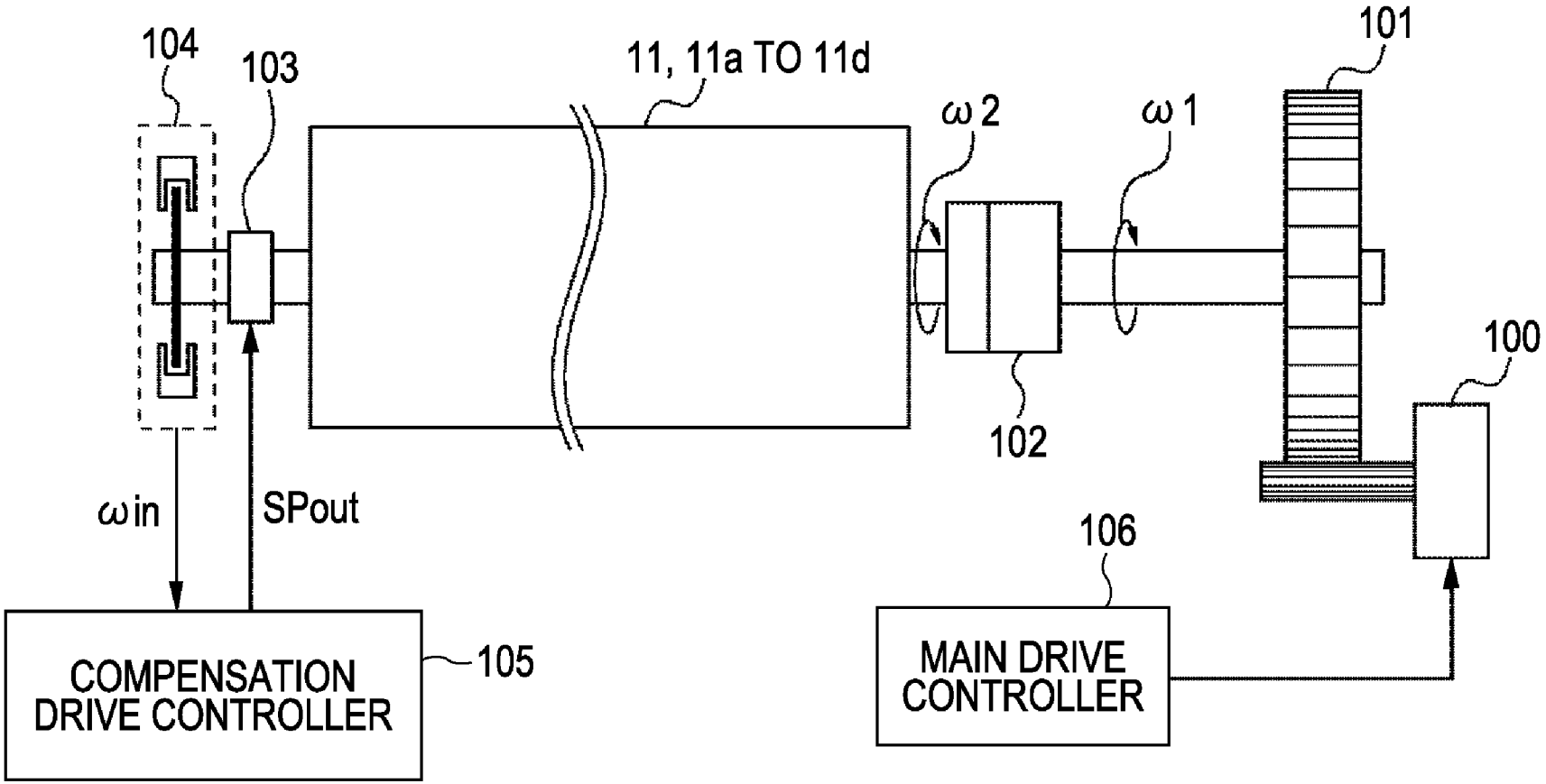
FIG. 2 is a diagram illustrating the structure for driving a photosensitive drum using a main drive unit and a compensation drive unit according to a first embodiment and a second embodiment.

As shown in FIG. 2, an output shaft of the compensation drive unit 103 and a rotating shaft of the corresponding photosensitive drum 11 are provided on the same shaft so that a torque generated by the compensation drive unit 103 can be directly applied to the photosensitive drum 11 without using a gear, a belt, or the like. The compensation drive unit 103 is controlled by a compensation drive controller 105.

The driving force generated by the main drive unit 100 is transmitted to the photosensitive drum 11 through a gear 101, which serves as a drive transmission unit (driving-force transmitting unit), and a torque limiter 102. Accordingly, the photosensitive drum 11 is rotated. The torque limiter 102 operates such that when the torque transmitted from the main drive unit 100 through the gear 101 exceeds a torque limit (limit torque), the excess torque is not transmitted to the photosensitive drum 11. In other words, the torque limiter 102 slips when the torque transmitted thereto exceeds the torque limit, and thereby limits the torque transmitted to the photosensitive drum 11. The torque limit of the torque limiter 102 is determined in advance as described below.

A torque required to rotate the photosensitive drum 11 at a constant angular velocity varies periodically. As described above, the cleaning device 15, the primary charger 12, the developing device 14, and the intermediate transfer belt 31 are disposed around the photosensitive drum 11. The cleaning device 15, the primary charger 12, the developing device 14, and the intermediate transfer belt 31 generate variations in the rotational load of the photosensitive drum 11. More specifically, the cleaning blade included in the cleaning device 15 is in contact with the photosensitive drum 11, and the frictional force applied by the cleaning blade periodically varies due to non-uniform surface characteristics of the photosensitive drum 11 and eccentricity of the photosensitive drum 11. In addition, the photosensitive drum 11 is in contact with the intermediate transfer belt 31, which is in contact with the cleaning blade 51, and variation in the frictional force applied by the cleaning blade 51 also affects the rotational load of the photosensitive drum 11 through the intermediate transfer belt 31. In addition, variations in potential differences between the photosensitive drum 11 and the primary charger 12 and between the photosensitive drum 11 and the developing device 14 also affect the rotational load of the photosensitive drum 11. Thus, the torque Treq required to rotate the photosensitive drum 11 periodically varies as shown in, for example, FIG. 4A.

Figure 4A:
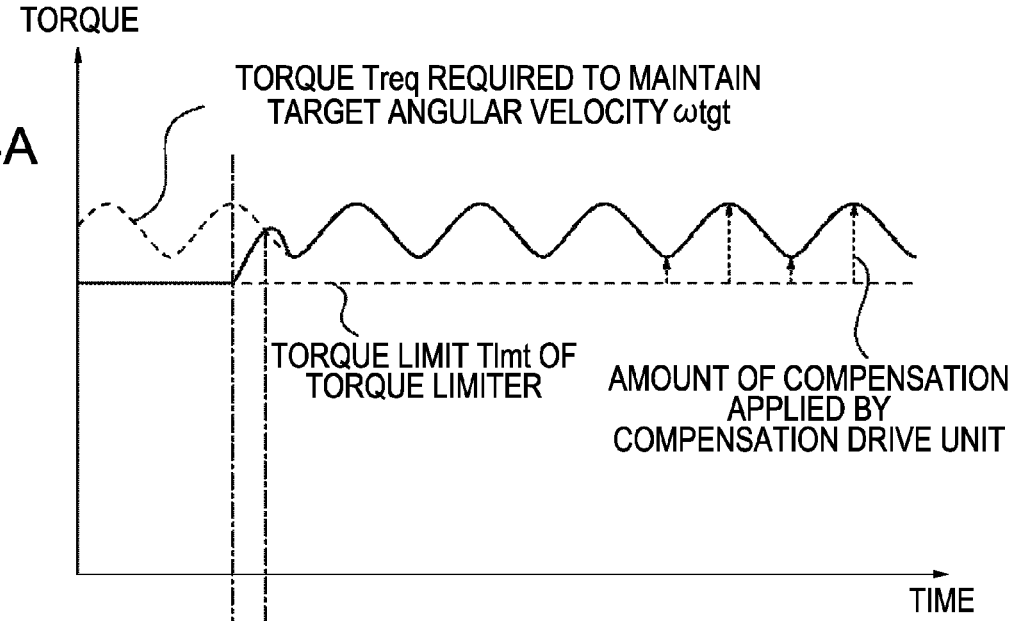
FIG. 4A is a graph showing the relationship between the torque limit Tlmt of a torque limiter and the torque Treq required to rotate the photosensitive drum.

According to the present embodiment, as shown in FIG. 4A, the torque limiter 102 has a torque limit Tlmt that is lower than the torque Treq required to rotate the photosensitive drum 11 at a target angular velocity ωtgt. Therefore, when the photosensitive drum 11 is caused to rotate at the target angular velocity ωtgt, the main drive unit 100 supplies the torque limit Tlmt to the photosensitive drum 11 and the compensation drive unit 103 compensates for the deficiency. Thus, load that periodically varies can be supplied to the photosensitive drum 11.

The main drive unit 100 is controlled by the main drive controller 106 such that the output shaft of the main drive unit 100 is rotated at a predetermined angular velocity. In the case where the main drive unit 100 is a stepping motor, the angular velocity of the main drive unit 100 is controlled by a known open-loop control system. In addition, in the case where the main drive unit 100 is a DC brushless motor, the angular velocity of the main drive unit 100 is controlled on the basis of pulses generated at a timing corresponding to the angular velocity of the output shaft.

Figure 4B:
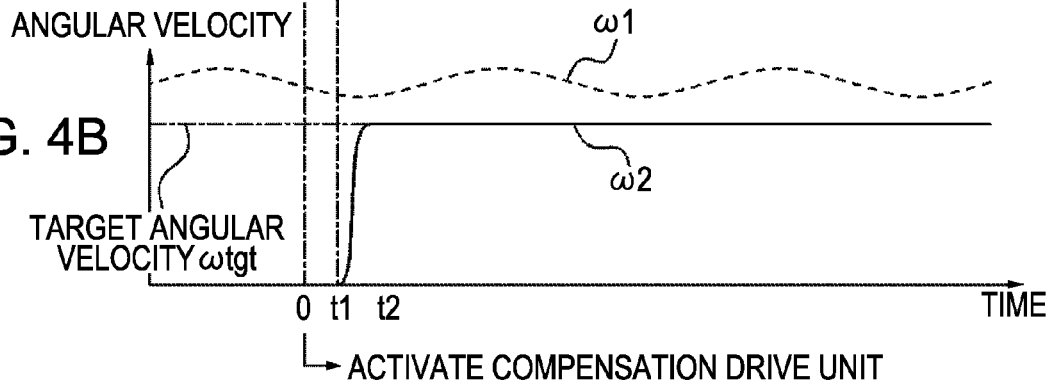
FIG. 4B is a graph showing the relationship between the angular velocity ω1 of a transmission shaft of a drive transmission unit and the angular velocity ω2 of the photosensitive drum.

However, even when the main drive unit 100 is controlled so as to rotate at a constant angular velocity, the drive transmission unit 101 and the photosensitive drum 11 do not rotate at a constant angular velocity due to the influence of, for example, eccentricity of the transmission shaft of the drive transmission unit 101. More specifically, as shown in FIG. 4B, the angular velocity ω1 of the transmission shaft of the drive transmission unit 101 varies.

However, since the torque Tlmt that is lower than the torque Treq required to obtain the rotation at the target angular velocity is transmitted to the photosensitive drum 11 through the torque limiter 102, the torque limiter 102 slips. Therefore, the angular velocity of the photosensitive drum 11 is determined by the angular velocity control performed by the compensation drive unit 103, and is adjusted to the constant target angular velocity ωtgt by the compensation drive controller 105. The torque applied by the compensation drive unit 103 is lower than the torque applied by the main drive unit 100. In addition, the responsiveness of the compensation drive unit 103 is higher than the responsiveness of the main drive unit 100. Thus, the compensation drive unit 103 is inferior to the main drive unit 100 with regard to the driving torque, but is superior to the main drive unit 100 with regard to the responsiveness. Therefore, the compensation drive unit 103 serves as a compensation drive source for maintaining the angular velocity of the photosensitive drum 11 at a constant value.

The main drive controller 106 controls the angular velocity of the output shaft of the main drive unit 100 such that the angular velocity ω1 at which the driving force is input from the main drive unit 100 to the torque limiter 102 is equal to or higher than the angular velocity ω2 of the photosensitive drum 11 (that is, equal to or higher than the target angular velocity). The reason for this is that if the compensation drive unit 103 increases angular velocity ω2 from zero to the target angular velocity while the angular velocity ω1 of the drive transmission unit 101 is lower than the angular velocity ω2 of the photosensitive drum 11, the angular velocity ω2 equals the angular velocity ω1 on the halfway of increasing the angular velocity ω2. The compensation drive unit 103 has to apply the torque larger than the torque limit Tlmt of the torque limiter 102 in order to make the angular velocity ω2 larger than the angular velocity ω1. However, in a case that the torque of the compensation drive unit 103 driving directly the photosensitive drum 11 is smaller than the torque limit Tlmt of the torque limiter 102, the compensation drive unit 103 can not increase the angular velocity ω2 to the target angular velocity larger than the angular velocity ω1. Accordingly, the main drive controller 106 controls the main drive unit 100 such that the angular velocity ω1 is larger than the target angular velocity of the photosensitive drum 11. In a case that the peripheral velocity of the photosensitive drum 11 is controlled, the angular velocity ω1 input to the torque limiter 102 from the main drive unit 100 is larger than the angular velocity ω2 corresponding to a target peripheral velocity of the photosensitive drum 11. In this case, the compensation drive controller 105 controls the angular velocity of the photosensitive drum 11 based on the peripheral velocity of the photosensitive drum 11 detected by an encoder.

The compensation drive controller 105 controls the angular velocity of the compensation drive unit 103 on the basis of the angular velocity of the photosensitive drum 11 detected by an encoder 104, which serves as an angular velocity detector, so that the photosensitive drum 11 rotates at the target angular velocity. If the angular velocity of the photosensitive drum 11 is too high, the compensation drive controller 105 decelerates the compensation drive unit 103. If the angular velocity of the photosensitive drum 11 is too low, the compensation drive controller 105 accelerates the compensation drive unit 103. The compensation drive controller 105 controls the compensation drive unit 103 by, for example, a proportional-integral-derivative (PID) control system. Instead of detecting the angular velocity of the photosensitive drum 11, the peripheral velocity of the photosensitive drum 11 may be detected, and the angular velocity of the compensation drive unit 103 may be controlled such that the peripheral velocity equals the target peripheral velocity.

Figure 3:
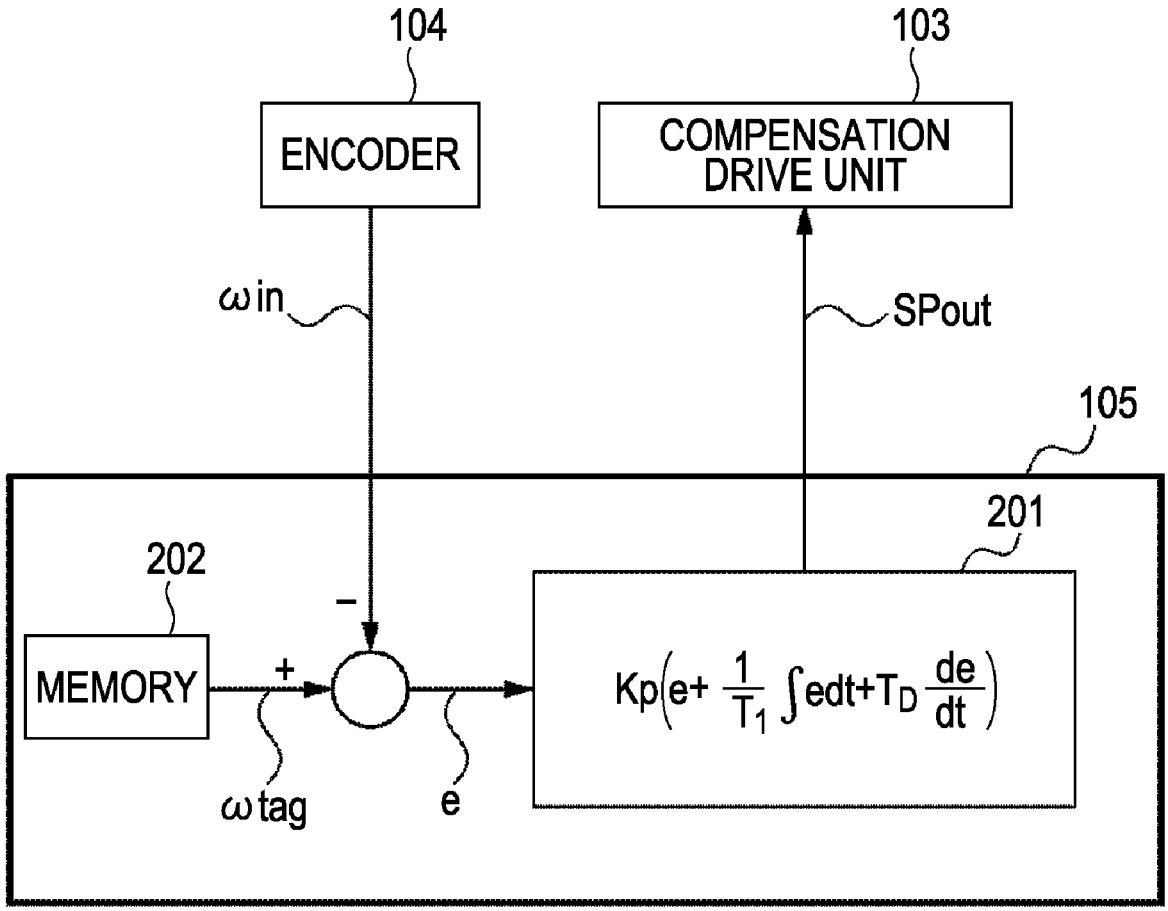
FIG. 3 is a diagram illustrating the structure of a compensation drive controller.

FIG. 3 is a diagram illustrating the detailed structure of the compensation drive controller 105. The encoder 104 detects the angular velocity of the photosensitive drum 11, and outputs an angular velocity signal ωin representing the detected angular velocity. A memory 202 stores the target angular velocity ωtgt of the photosensitive drum 11. A difference e between the target angular velocity ωtgt and the angular velocity ωin is input to a PID calculator 201. The PID calculator 201 calculates a PID control value Spout on the basis of the input difference e and supplies the PID control value Spout to the compensation drive unit 103. Thus, feedback control of the compensation drive unit 103 is performed on the basis of the angular velocity of the photosensitive drum 11. Here, KP, TI, and TD are a proportional gain, an integral gain, and a derivative gain, respectively.

FIG. 4A is a graph showing the relationship between the torque limit Tlmt of the torque limiter 102 and the torque Treq required to rotate the photosensitive drum 11 at the target angular velocity ωtgt. FIG. 4B is a graph showing the relationship between the angular velocity ω1 of the transmission shaft of the drive transmission unit and the angular velocity ω2 of the photosensitive drum 11. To facilitate understanding of the operation of the present embodiment, in the graph, the time period before time 0 shows the state in which the compensation drive unit 103 is not activated, and the time period after time 0 shows the state in which the compensation drive unit 103 is activated to rotate the photosensitive drum 11 at the target angular velocity.

In the above-described embodiment, the USM is used as the compensation drive unit 103. However, the photosensitive drum 11 may also be driven by a stepping motor or a DC brushless motor together with a gear, a pulley, etc., instead of using the USM. However, the USM can be used to directly drive the photosensitive drum 11 without using a gear, a pulley, or the like. In such case, the responsiveness and accuracy can be ensured.

In the above-described embodiment, the compensation drive control is performed by detecting the angular velocity of the photosensitive drum 11. However, the compensation drive control can also be performed by detecting an angular displacement or an angular acceleration of the photosensitive drum 11.

According to the above-described structure, the main drive unit 100 supplies torque to the photosensitive drum 11 through the torque limiter 102. In addition, the compensation drive unit 103 compensates for the deficiency in the torque, and is controlled such that the photosensitive drum 11 rotates at the target angular velocity.

A second embodiment of the present invention will be described below referring to the drawings. In the first embodiment, the torque limit Tlmt of the torque limiter 102 is lower than the required torque Treq. However, the torque limit Tlmt is not limited to this, and may also be set to a torque that is greater than the required torque Treq or a torque within the variation range of the required torque Treq.

In the second embodiment, a case is considered in which the torque limit Tlmt of the torque limiter 102 is greater than the required torque Treq. The basic structure of the second embodiment is similar to that described above with reference to FIGS. 1 to 3. The second embodiment differs from the first embodiment in that the compensation drive unit 103 applies a brake, that is, a negative torque.

Figure 5A:
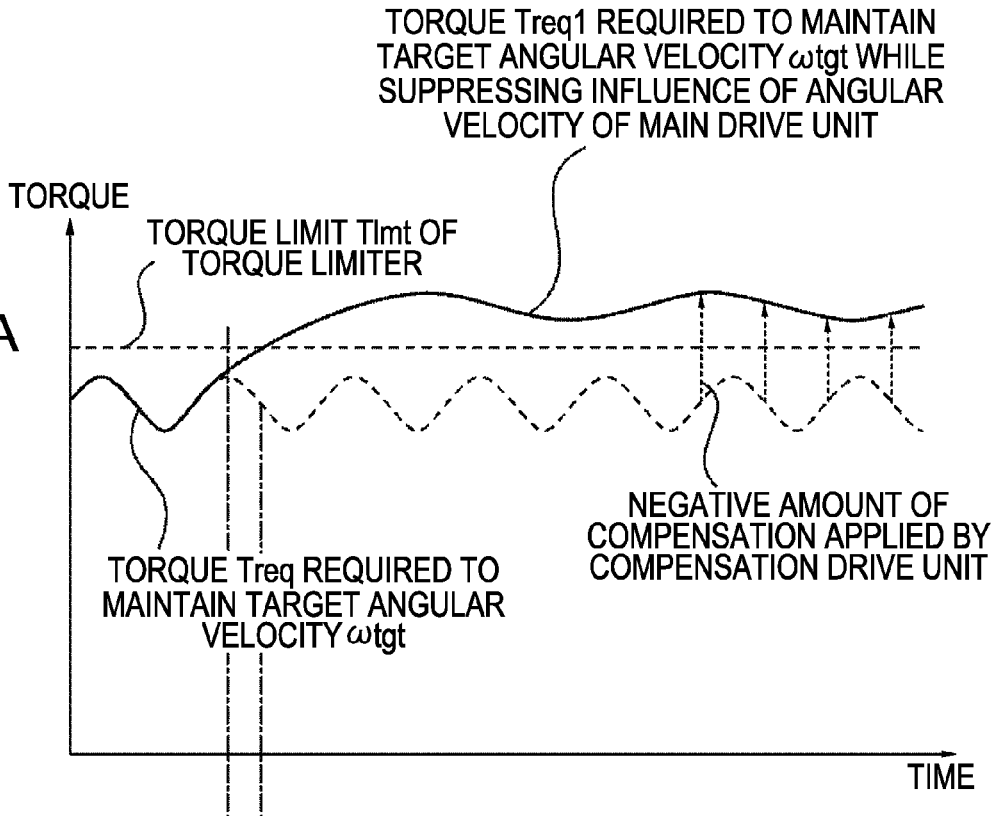
FIG. 5A is a graph showing the relationship between the torque limit Tlmt of the torque limiter and the torque Treq required to rotate a photosensitive drum.
Figure 5B:
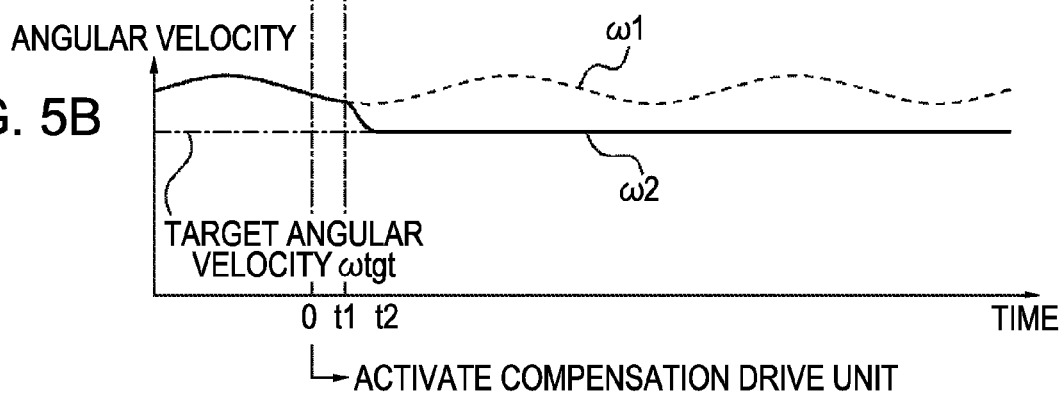
FIG. 5B is a graph showing the relationship between the angular velocity ω1 of the transmission shaft of the drive transmission unit and the angular velocity ω2 of the photosensitive drum.

FIG. 5A is a graph showing the relationship between the torque limit Tlmt of the torque limiter 102 and the torque Treq required to rotate the photosensitive drum 11 at the target angular velocity ωtgt. FIG. 5A also shows the relationship between the torque limit Tlmt and the torque Treq1 required to rotate the photosensitive drum 11 at the target angular velocity ωtgt by reducing the influence of the main drive unit 100. FIG. 5B is a graph showing the relationship between the angular velocity ω1 of the transmission shaft of the drive transmission unit and the angular velocity 107 2 of the photosensitive drum 11. To facilitate understanding of the operation of the present embodiment, in the graph, the time period before time 0 shows the state in which the compensation drive unit 103 is not activated, and the time period after time 0 shows the state in which the compensation drive unit 103 is activated to rotate the photosensitive drum 11 at the target angular velocity.

Since the torque limit Tlmt of the torque limiter 102 is greater than the torque Treq, while the compensation drive unit 103 is not activated, the photosensitive drum 11 is rotated at the angular velocity ω1 due to the torque applied by the main drive unit 100. Similarly to the first embodiment, the main drive control unit 106 controls the main drive unit 100 such that the angular velocity ω1 is larger than the target angular velocity of the photosensitive drum 11. To rotate the photosensitive drum 11 at the target angular velocity ωtgt, the compensation drive unit 103 applies a negative torque. When the compensation drive unit 103 applies a negative torque (braking force), the torque Treq1 required to maintain the angular velocity at the target angular velocity ωtgt is obtained. At this time, the torque Treq1 exceeds the torque limit Tlmt and the torque limiter 102 slips. Therefore, the angular velocity of the photosensitive drum 11 is determined by the compensation drive unit 103. The compensation drive unit 103 applies a negative torque necessary for causing the torque limiter 102 to slip and a negative torque necessary for reducing the angular velocity ω1 of the photosensitive drum driven by the main drive unit 100 to the target angular velocity ωtgt. Thus, the angular velocity of the photosensitive drum 11 can be adjusted to the constant target angular velocity ωtgt by the compensation drive controller 105.

According to the present embodiment, the USM is used as the compensation drive unit 103 and the negative torque is applied by adjusting the angular velocity of the photosensitive drum 11 to the target angular velocity ωtgt on the basis of the result of detection of the angular velocity of the photosensitive drum 11. According to the present embodiment, the compensation drive unit 103 applies a negative torque. Therefore, other mechanisms such as a powder brake, a hysteresis brake, etc., which is capable of controlling a braking torque can also be used as the compensation drive unit 103.

In the case where the torque limit Tlmt of the torque limiter is within the variation range of the required torque Treq, the compensation drive unit 103 is required to apply both a positive torque and a negative torque. In such a case, instead of a mechanism having only a braking function, it is necessary to use a motor like an USM or a stepping motor that is capable of applying a positive torque.

A third embodiment of the present invention will be described below referring to the drawings. In the first embodiment, the main drive unit 100 is rotated at a predetermined angular velocity. However, according to a third embodiment, the main drive unit 100 is controlled by feeding back the angular velocity ω1 of the transmission shaft of the drive transmission unit. The structures of the present embodiment other than the structure shown in FIG. 6 are similar to those of the first embodiment.

Figure 6:
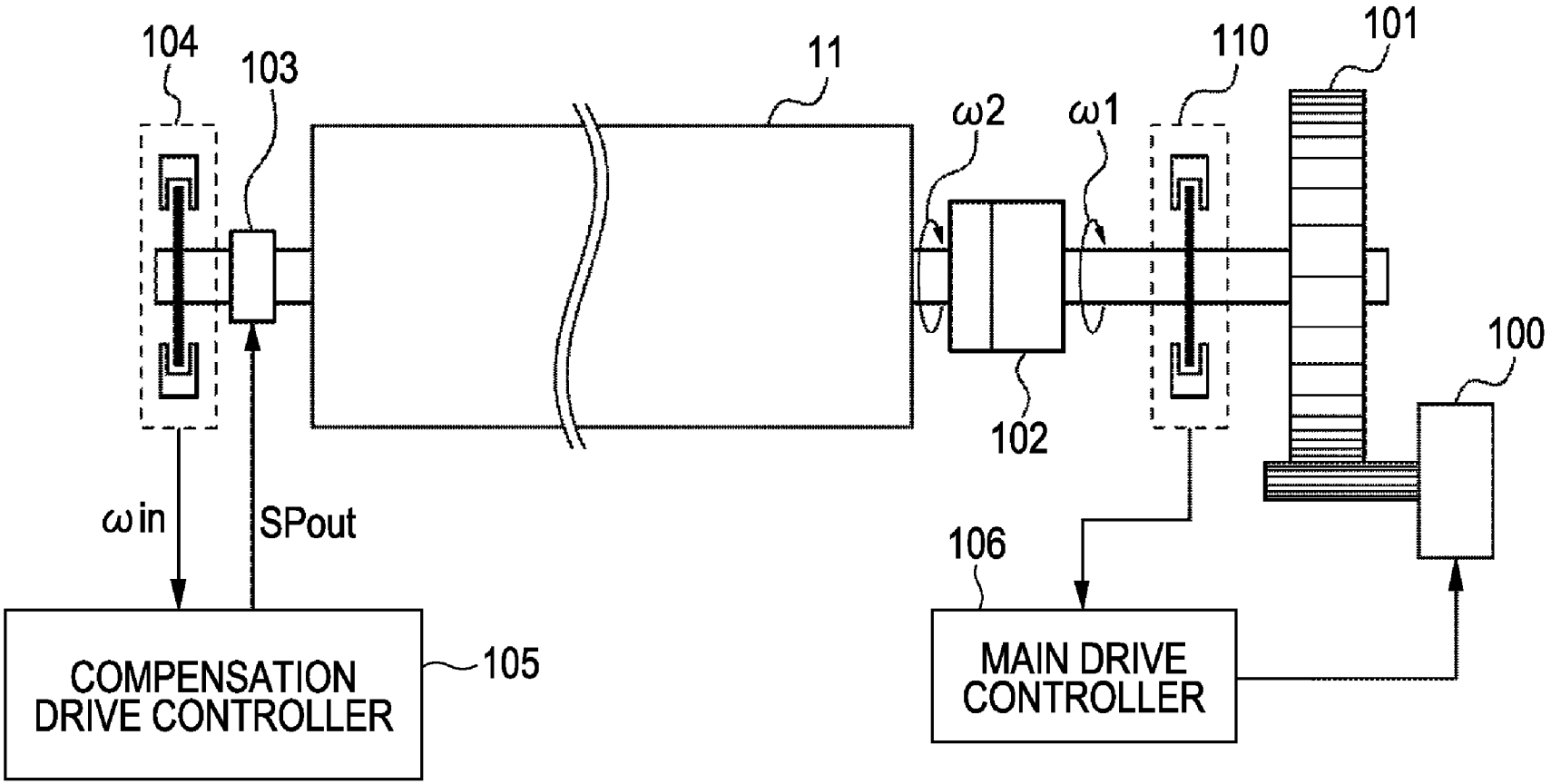
FIG. 6 is a diagram illustrating the structure for driving a photosensitive drum using a main drive unit and a compensation drive unit according to a third embodiment.

As shown in FIG. 6, an encoder 110 (second detector) for detecting an angular velocity ω1 of the transmission shaft of the drive transmission unit 101 is provided between the torque limiter 102 and the drive transmission unit 101. The main drive controller 106 (second control unit) controls the main drive unit 100 on the basis of the detection result obtained by the encoder 110 such that the angular velocity ω1 is maintained constant. Similarly to the first embodiment, the main drive control unit 106 controls the main drive unit 100 such that the angular velocity ω1 is larger than the target angular velocity of the photosensitive drum 11. Thus, the difference between the angular velocity ω1 of the transmission shaft of the drive transmission unit 101 and the angular velocity ω2 of the photosensitive drum 11 can be minimized. Since the main drive unit 100 does not drive excessively, an electric power saving can be promoted.

The main drive controller 106 performs feedback control similar to that performed by the compensation drive controller 105. The target angular velocity of the main drive controller 106 is set to a value greater than the target angular velocity ωtgt by a certain percentage (for example, 2%).

A fourth embodiment of the present invention will be described below referring to the drawings. In the first to third embodiment, the main drive unit 100 is provided for each of the photosensitive drums 11*a* to 11*d*. However, two or more photosensitive drums 11 (for example, the photosensitive drums 11*a* and 11*b*) may be driven by a single main drive unit 100.

Figure 7:
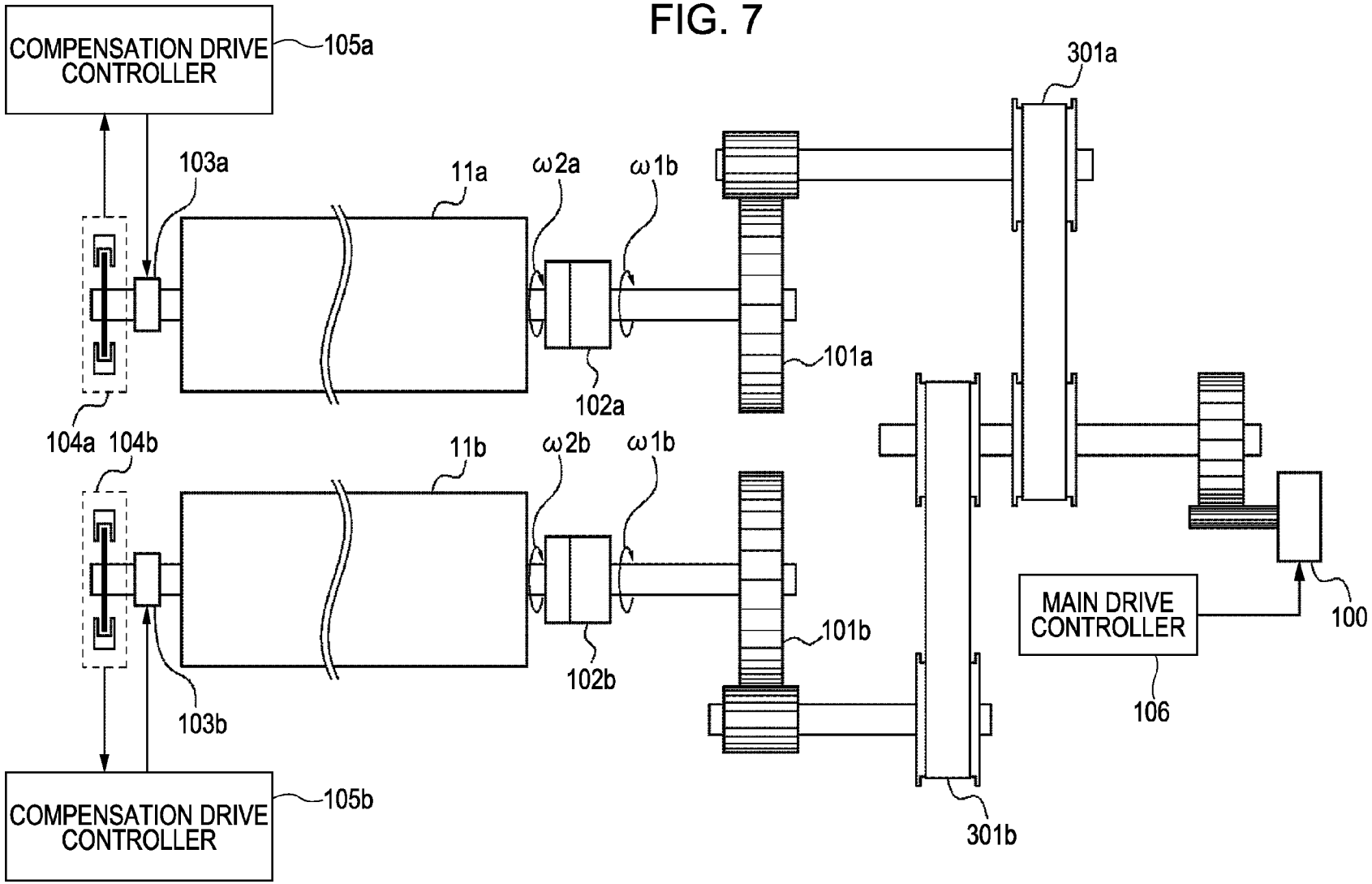
FIG. 7 is a diagram illustrating the structure for driving photosensitive drums using a main drive unit and compensation drive units according to a fourth embodiment.

In the present embodiment, as shown in FIG. 7, the main drive unit 100 drives two photosensitive drums 11*a* and 11*b* through pulleys 301*a* and 301*b*, respectively. The photosensitive drums 11*a* and 11*b* are respectively provided with torque limiters 102*a* and 102*b*, compensation drive units 103*a* and 103*b*, encoders 104*a* and 104*b*, and compensation drive controllers 105*a* and 105*b*, and the angular velocity control is performed for each of the photosensitive drums 11*a* and 11*b* individually.

Figure 8:
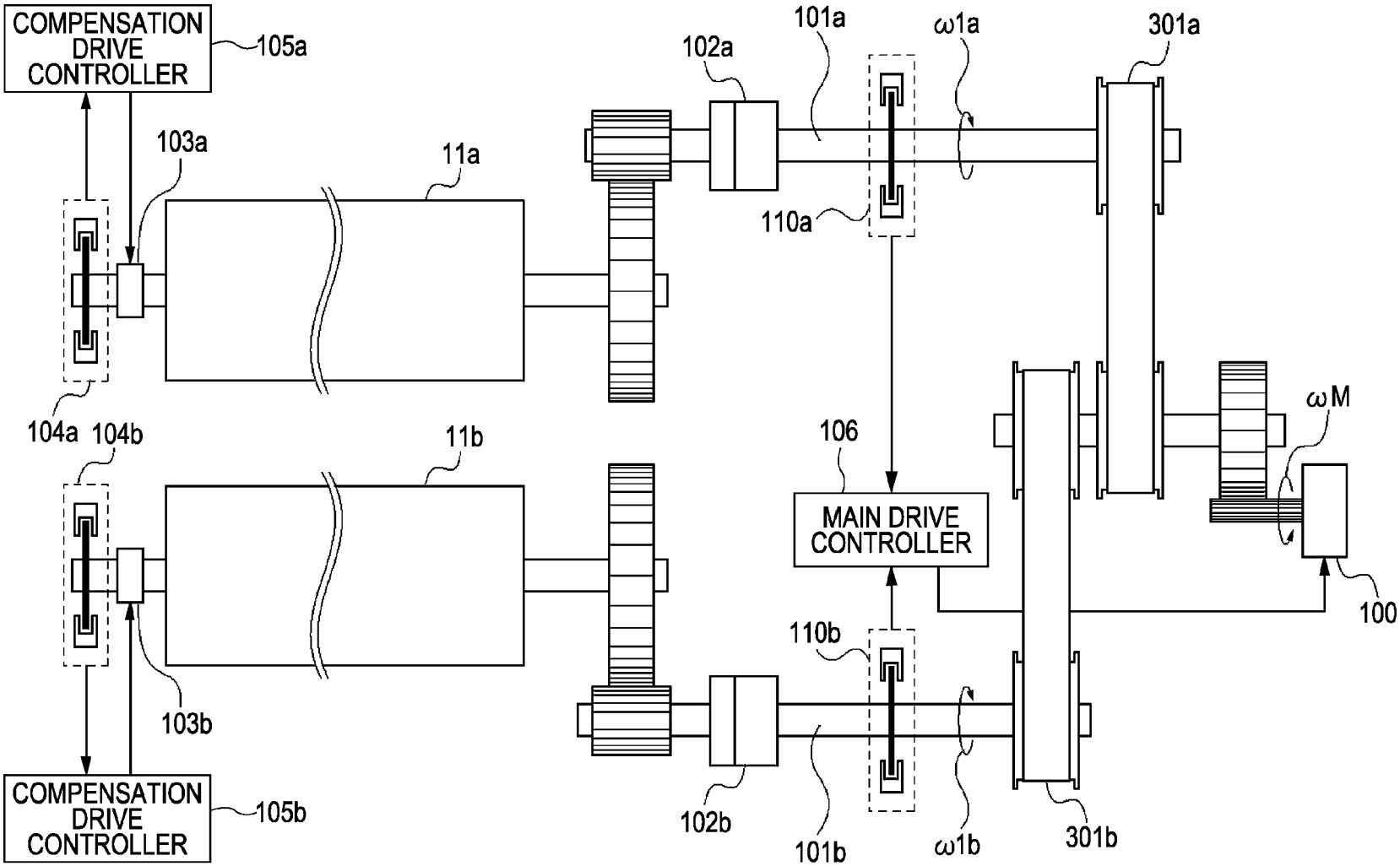
FIG. 8 is a diagram illustrating the structure for driving photosensitive drums using a main drive unit and compensation drive units according to a fifth embodiment.

A fifth embodiment of the present invention will be described below referring to the drawings. The structure according to the third embodiment may be used in the structure according to the fourth embodiment. More specifically, as shown in FIG. 8, drive transmission units 101*a* and 101*b* can be provided with encoders 110*a* and 110*b*, respectively. The angular velocity of the main drive unit 100 is controlled on the basis of the outputs from the encoders 110*a* and 110*b* such that the angular velocity is not reduced to below the target angular velocity.

Figure 9A:
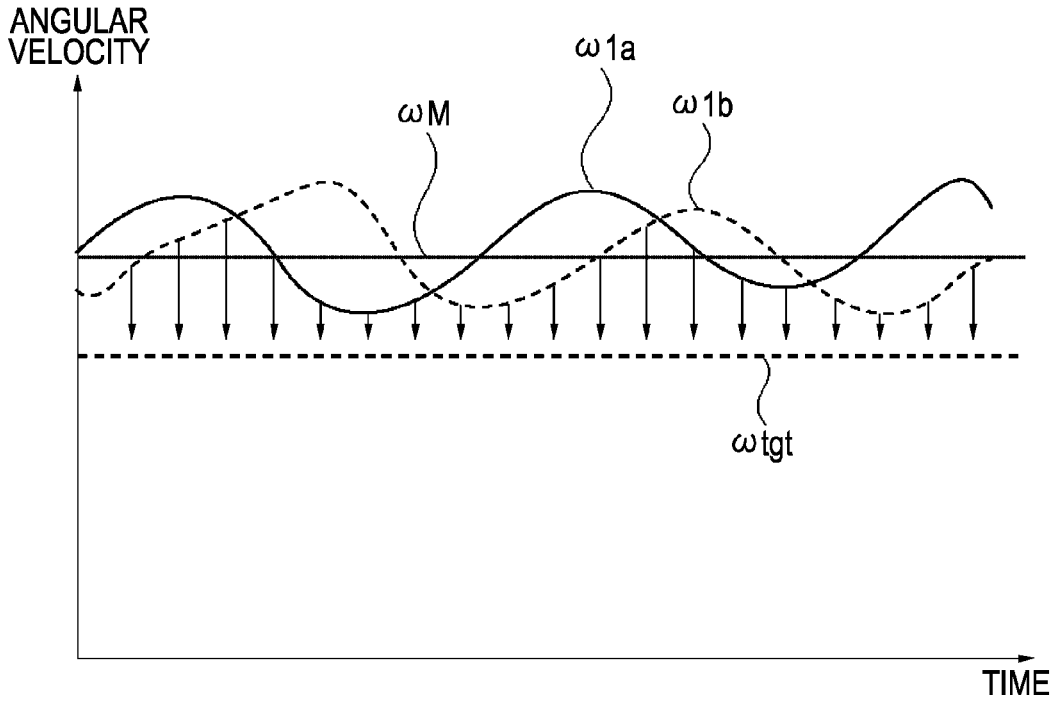
FIGS. 9A and 9B are graphs showing the relationship between the angular velocities ω1*a* and ω1*b* of transmission shafts of drive transmission units and the angular velocity ωM of the photosensitive drums according to the fifth embodiment.
Figure 9B:
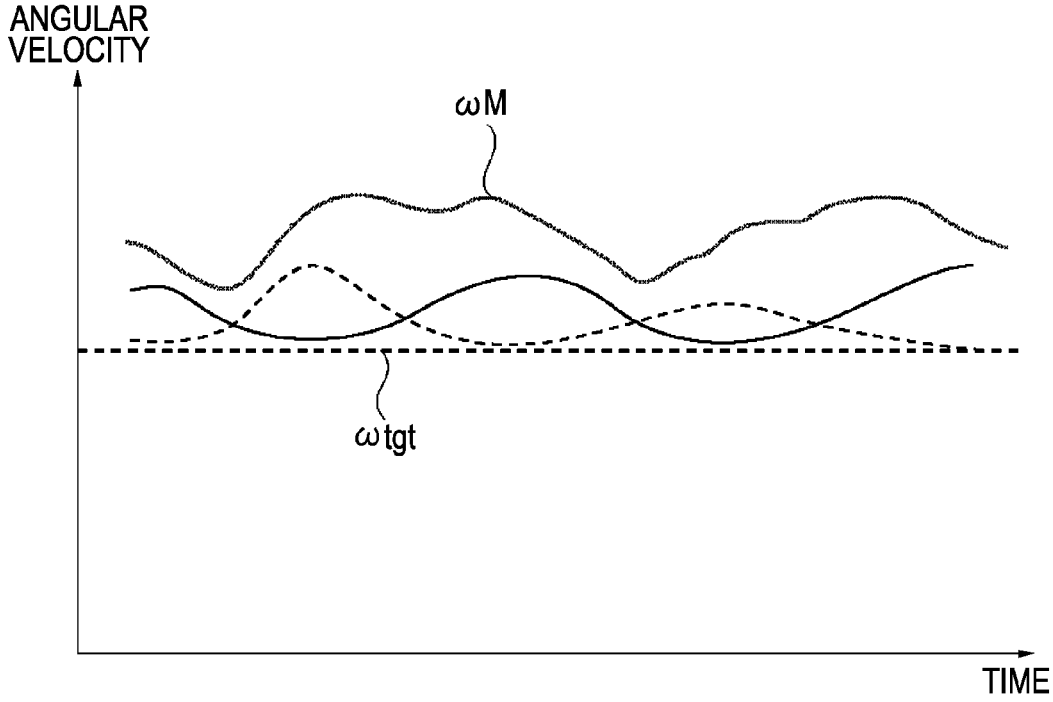

FIG. 9A is a diagram illustrating the state in which the control operation according to the present embodiment is not performed. According to the present embodiment, as shown in FIG. 9B, the angular velocity ωM of the main drive unit 100 is varied in accordance with a lower one of the angular velocities detected by the encoders 110*a* and 110*b*. Thus, the angular velocity of the main drive unit 100 is controlled so as not to become lower than the target angular velocity in either of the drive transmission units 101*a* and 101*b*. Therefore, the differences between the angular velocities of the drive transmission units 101*a* and 101*b* and the angular velocities of the photosensitive drums 11*a* and 11*b* can be minimized.

The torque limiters 102*a* and 102*b* may be disposed at any positions as long as they are positioned between the main drive unit 100 and the photosensitive drums 11*a* and 11*b*.

Although examples of structures for driving photosensitive drums are explained in the above-described embodiments, the present invention is not limited to the structures for driving photosensitive drums and may also be applied to rotary member driving apparatuses for driving other types of rotary members.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2008-086959 filed Mar. 28, 2008, which is hereby incorporated by reference herein in its entirety.

What is claimed is:

1. A rotary member driving apparatus, comprising:

a driving unit configured to apply a driving torque to a rotary member through a transmission member;

a torque limiting unit provided on the transmission member, the torque limiting unit limiting the driving torque transmitted from the driving unit to the rotary member;

a compensation unit configured to apply a torque for adjusting an angular velocity of the rotary member;

a first detection unit configured to detect the angular velocity or a peripheral velocity of the rotary member;

a first control unit configured to control the torque applied by the compensation unit based on a detection result obtained by the first detection unit;

a second detection unit configured to detect an angular velocity input to the torque limiting unit from the driving unit; and a second control unit configured to control an angular velocity of the driving unit based on a detection result obtained by the second detection unit.

2. The rotary member driving apparatus according to claim 1, wherein a limit torque of the torque limiting unit is lower than a torque required to rotate the rotary member, and the compensation unit applies an additional torque so that the rotary member rotates at a target angular velocity.

3. The rotary member driving apparatus according to claim 1, wherein a limit torque of the torque limiting unit is higher than a torque required to rotate the rotary member, and the compensation unit applies a negative torque so that the rotary member rotates at a target angular velocity.

4. The rotary member driving apparatus according to claim 1, wherein the driving unit is controlled such that an angular velocity input to the torque limiting unit by the driving unit is equal to or higher than a target angular velocity of the rotary member.

5. The rotary member driving apparatus according to claim 1, wherein a responsiveness of the compensation unit is higher than a responsiveness of the driving unit.

6. The rotary member driving apparatus according to claim 1, wherein the torque applied by the compensation unit is lower than the torque applied by the driving unit.

7. The rotary member driving apparatus according to claim 1, wherein the driving unit and the compensation unit are motors.

8. The rotary member driving apparatus according to claim 7, wherein an output shaft of the motor which functions as the compensation unit and a rotating shaft of the rotary member are on the same shaft, and the compensation unit directly applies the torque to the rotary member.

9. The rotary member driving apparatus according to claim 1, wherein the rotary member is an image bearing member which bears an image for forming the image on a sheet of paper.

10. The rotary member driving apparatus according to claim 1, wherein the compensation unit is a traveling wave motor.

11. A rotary member driving apparatus, comprising:

a driving unit configured to apply a driving torque to a plurality of rotary members through respective transmission members;

torque limiting units provided on the respective transmission members, the torque limiting units limiting the driving torque transmitted from the driving unit to the rotary members;

compensation units provided for the respective rotary members and configured to apply torques for adjusting angular velocities of the rotary members;

first detection units provided for the respective rotary members, the first detection units detecting the angular velocities or peripheral velocities of the respective rotary members;

first control units configured to control the torques applied by the respective compensation units based on detection results obtained by the first detection units;

second detection units configured to detect angular velocities input to the torque limiting units from the driving unit; and a second control unit configured to control an angular velocity of the driving unit based on detection results obtained by the second detection units.

12. A rotary member driving apparatus, comprising:

a driving unit configured to apply a driving torque to a rotary member through a transmission member;

a torque limiting unit provided on the transmission member, the torque limiting unit limiting the driving torque transmitted from the driving unit to the rotary member; and a compensation unit configured to apply a torque for adjusting an angular velocity of the rotary member, wherein the angular velocity input to the torque limiting unit from the driving unit is larger than a target angular velocity of the rotary member, and wherein the compensation unit rotates the rotary member at the target angular velocity.

13. A rotary member driving apparatus, comprising:

a driving unit configured to apply a driving torque to a rotary member through a transmission member;

a torque limiting unit provided on the transmission member, the torque limiting unit limiting the driving torque transmitted from the driving unit to the rotary member; and a compensation unit configured to apply a torque for adjusting a peripheral velocity of the rotary member, wherein an angular velocity input to the torque limiting unit from the driving unit is larger than an angular velocity corresponding to a target peripheral velocity of the rotary member, and wherein the compensation unit rotates the rotary member at the target peripheral velocity.

* * * * *